United States Patent [19]

Sawada

[11] Patent Number: 4,693,159

[45] Date of Patent: Sep. 15, 1987

[54] WOODEN FRAME FOR A GRAND PIANO

[75] Inventor: Ichiro Sawada, Hamamatsu, Japan

[73] Assignee: Nippon Gakki Seizo Kabushiki Kaisha, Japan

[21] Appl. No.: 739,363

[22] Filed: May 30, 1985

[30] Foreign Application Priority Data

Jun. 8, 1984 [JP] Japan ..... 59-084209[U]
Feb. 27, 1985 [JP] Japan ..... 60-026299[U]

[51] Int. Cl.[4] ..... G10C 3/04
[52] U.S. Cl. ..... 84/186 R; 84/177
[58] Field of Search ..... 84/184–186 R, 84/186 WP, 177

[56] References Cited

U.S. PATENT DOCUMENTS 1,013,604 1/1912 Lechner ..... 84/185
3,415,151 12/1968 Noda ..... 84/186 R

FOREIGN PATENT DOCUMENTS 210694 2/1924 United Kingdom ..... 84/186 R

*Primary Examiner*—Benjamin R. Fuller
*Attorney, Agent, or Firm*—Ostrolenk, Faber, Gerb & Soffen

[57] ABSTRACT

In construction of a wooden frame for a grand piano, rigidity of the bass range section of a curved frame is on purpose raised in order to make up for difference in rigidity which is otherwise unavoidably caused by configurational factors for balanced generation of beautiful tones over the entire tone ranges.

16 Claims, 6 Drawing Figures

WOODEN FRAME FOR A GRAND PIANO

BACKGROUND OF THE INVENTION

This invention relates to a wooden frame for a grand piano, and more particularly relates to improvement in tone generating function of a wooden frame used for a grand piano.

In construction of a grand piano, a wooden frame functions as a support for a cast plate and, as a consequence, is required to have a mechanical strength sufficient for limiting warping of the plate which is otherwise caused by string tension. It is also required for a wooden frame to promote effective string vibrations through a sound board for balanced generation of tones from the bass to the treble range. Maintenance of sufficient strength is in particular important in order to keep standard string height, allow simple tone adjustment and maintain stable key touch over a long period.

A curved frame is a basic element in construction of a wooden frame and generally includes a straight bass range section and a curved treble range section. These sections have different rigidities due to difference in configuration. That is, since a curved section is inherently more rigid than a straight section, the rigidity of the straight bass range section is in general less than that of the curved treble range section. Since these two sections are same in height and thickness for convenience of in production, no configurational factors can make up for this difference in rigidity. As a result, the bass range section is inferior in tone volume and tone quality, thereby preventing balanced generation of beautiful tones over entire tone ranges.

In some conventional prior art frames, lamination of thin wooden plates is employed in the production of a curved frame of a wooden frame because of its excellent workability. For example, low density thin wooden plates made of meranti or lauan are laminated with high density thin wooden plates made of matoa, beech tree or birch tree. After lamination, the laminated body is worked into the shape of a curved frame of a wooden frame. Although the laminated body itself has uniform rigidity over its entire length, bending of the laminated body produces differences in the rigidity between, the bass and treble range sections. Thus, the prior use of art's lamination has not avoided the problem of unbalanced tone generation due to difference in rigidity.

SUMMARY OF THE INVENTION

It is the object of the present invention to provide a wooden frame for a grand piano which allows balanced generation of beautiful tones over entire tone ranges despite the unavoidable differences in configuration between the bass the treble range sections of the curved frame of the wooden frame.

In accordance with the basic aspect of the present invention, in construction of a wooden frames for a grand piano, a curved frame is made up of a treble range section and a bass range section whose rigidity is larger than that of the treble range section.

DESCRIPTION OF THE PREFERRED EMBODIMENTS

Figure 1:
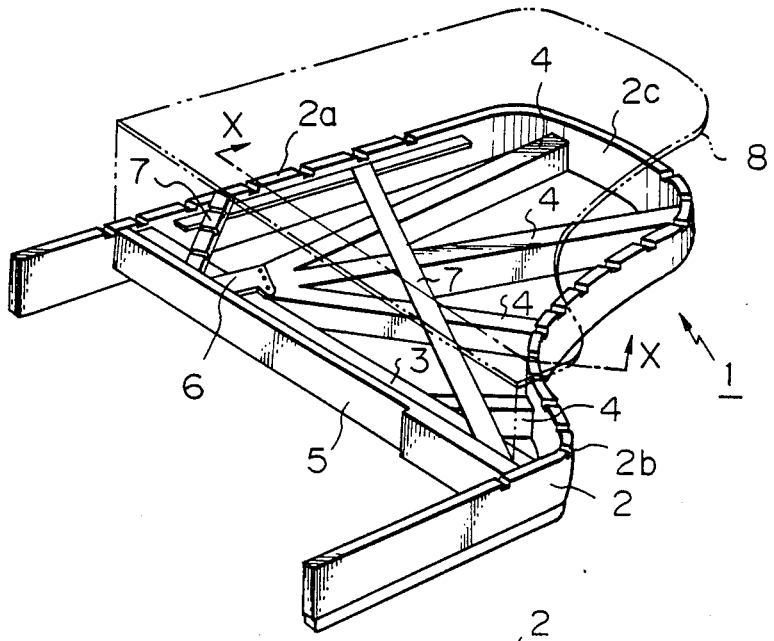
FIG. 1 is a perspective view of one example of a wooden frame to which the present invention is well applicable.

One typical example of the wooden frame to which the present invention is well applied is shown in FIG. 1, in which the wooden frame 1 includes a substantially U-shaped curved frame 2 opening forwards. The curved frame 2 is made up of a substantially straight bass range section 2*a*, an inwardly convex treble range section 2*b* and a middle range section 2*c* intervening these two sections. Near its open end, the curved frame 2 is spanned by a rear beam 3. A plurality of reinforcement ribs 4 extend horizontally between the inner face of the rear beam 3 and the inner face of the curved frame 2. The rear beam 3, the reinforcement ribs 4 and an intermediate beam 5 accompanying the rear beam 3 are joined together by means of a connector 6. Further, the reinforcement ribs 4 are connected to each other by means of an overhead cross strap 7. A sound board 8 is placed on the wooden frame 1 as shown in phantom with chain lines.

Figure 2:
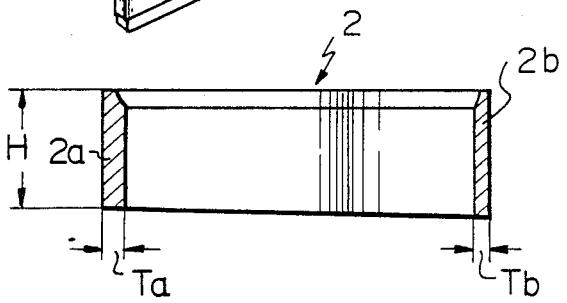
FIG. 2 is a cross-sectional view of one embodiment of the wooden frame in accordance with the present invention taken along a line x—x in FIG. 1.

As briefly described above, the present invention is directed to the construction of the curved frame 2 and a first embodiment is shown in FIG. 2. In the case of this embodiment, the thickness Ta of the bass range section 2*a* is larger than the thickness Tb of the treble range section 2*b* although both sections have a substantially same height H. In one actual example, the thickness Ta of the bass range section 2*a* is about 45 mm and the thickness Tb of the treble section 2*b* is about 37 mm.

Figure 3:
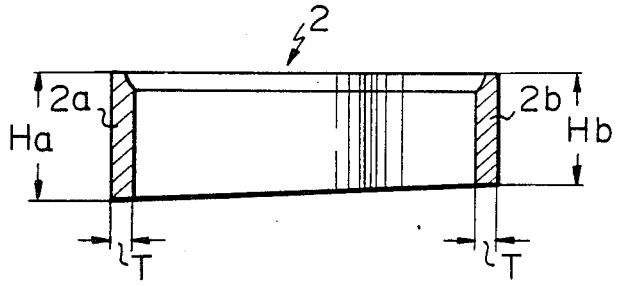
FIG. 3 is a like cross-sectional view of another embodiment of the wooden frame in accordance with the present invention.

A second embodiment of the invention is shown in FIG. 3, in which the height Ha of the bass range section is larger than the height Hb of the treble range section 2*b* although both sections have a substantially same thickness T. In one actual example, the height Ha of the bass range section is about 165 mm and the height Hb of the treble range section is about 115 mm.

Figure 4:
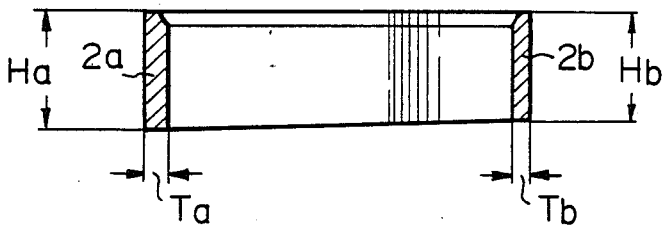
FIG. 4 is a like cross-sectional view of the other embodiment of the wooden frame in accordance with the present invention.

A third embodiment of the invention shown in FIG. 4 is a combination of the first and second embodiments. More specifically, the thickness Ta and height Ha of the bass range section 2*a* are larger than the thickness Tb and height Hb of the treble range section 2*b*, respectively.

The thickness and/or the height may be changed stepwise from the bass to treble range section via the middle range section.

The relatively larger construction of the bass range section 2*a* caused by its larger thickness and/or height increases the rigidity of the bass range section 2*a* and well offsets the above-described deficiency in rigidity unavoidably caused by the configurational factors.

Though not shown in the drawings, a fourth embodiment of the present invention includes bass and treble range sections of substantially the same thickness and height but one or more heavy masses are embedded in the bass range section in order to make up for its small rigidity.

Figure 5:
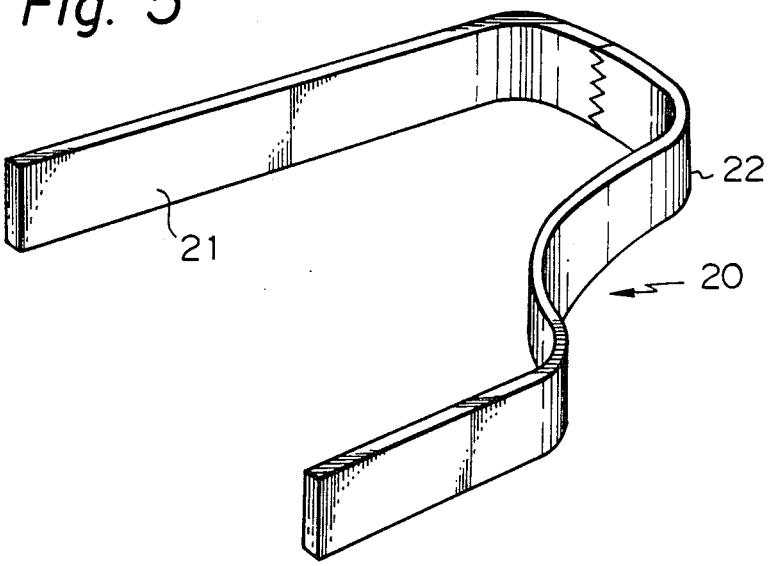
FIG. 5 is a perspective view of still other embodiment of the wooden frame in accordance with the present invention.
Figure 6:
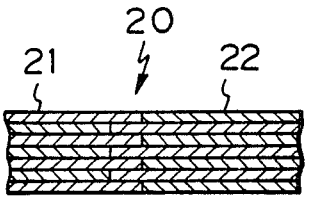
FIG. 6 is a cross-sectional view of the wooden frame shown in FIG. 5.

A fifth embodiment of the present invention is shown in FIGS. 5 and 6 in which the art of lamination is introduced. More specifically, a curved frame 20 includes a bass range section 21 and a treble range section 22 coupled together in the area of the middle range section via finger or scarf joints. The bass range section 21 takes the form of a laminated board made of high rigidity woods such as maple, beech tree, heritiera and meranti. Whereas the treble range section 22 takes the form of a laminated board made of woods such as maple, beech tree and spruce. Introduction of the art of lamination assures high workability of the material at production of the wooden frame.

I claim:

1. A curved wooden frame for a grand piano, comprising:

at least three interconnected sections, including a treble range section, a bass range section, and a middle range section, said bass range section and said treble range section comprising wooden material, the rigidity of the wooden material of said bass range section being greater than that of the wooden material of said treble range section, and said middle range section intervening said treble and bass range sections.

2. A curved wooden frame as claimed in claim 1, in which the rigidity of the material of the respective sections of said curved frame increases stepwise from said treble range section to said bass range section via said middle range section.

3. A curved wooden frame as claimed in either claim 1 or claim 2, in which the thickness of the material of said bass range section is larger than that of said treble range section.

4. A curved wooden frame as claimed in either claim 1 or claim 2, in which the height of the material of said bass range section is larger than that of said treble range section.

5. A curved wooden frame as claimed in either claim 1 or claim 2, in which both the thickness and the height of the material of said bass range section are larger than those of said treble range section, respectively.

6. A curved wooden frame as claimed in either claim 1 or clam 2, in which one or more heavy masses are embedded in the material of said bass range section.

7. A curved wooden frame for a grand piano, comprising:

a treble range section made of wooden material, a bass range section made of wooden material whose rigidity is greater than that of said treble range section, and a middle range section intervening said treble and bass range sections, in which the wooden material of said bass and treble range sections take the form of laminated boards coupled to each other in the area of said middle range section, and said laminated board for said bass range section is made of woods of greater rigidity than that of the material making said laminated board for said treble range section.

8. A curved wooden frame as claimed in claim 7, in which the rigidity of said curved frame increases stepwise from said treble range section to said bass range section via said middle range section.

9. A curved wooden frame for a grand piano, comprising:

a substantially straight bass range section comprising wood material having a first thickness;

a curved treble range section comprising wood material having a second thickness, less than said first thickness; and a wooden middle range section intervening and interconnecting said treble and bass range sections.

10. A curved wooden frame as claimed in claim 9, wherein the height of said bass and treble range sections are equal.

11. A curved wooden frame for a grand piano, comprising:

a substantially straight bass range section comprising wood material having a first height;

a curved treble range section comprising wood material having a second height, less than said first height; and a wooden middle range section intervening and interconnecting said treble and bass range sections.

12. A curved wooden frame as claimed in claim 11, wherein the thickness of said bass and treble range sections are equal.

13. A curved wooden frame for a grand piano, comprising:

a substantially straight bass range section comprising wood material having a first height and a first thickness;

a curved treble range section comprising wood material having a second height and a second thickness, said second height and second thickness being less than said first height and first thickness, respectively; and a wooden middle range section intervening and interconnecting said treble and bass range sections.

14. A curved wooden frame for a grand piano, comprising:

a substantially straight bass range section comprising wood material having one or more heavy masses embedded therein;

a curved wooden treble range section; and a wooden middle range section intervening and interconnecting said treble and bass range sections.

15. A curved wooden frame as claimed in claim 14, wherein the height and thickness of said bass and treble range sections are equal.

16. A curved wooden frame as claimed in any one of claims 10, 12, 13 or 15 wherein said bass and treble range sections are formed of the same type of wood.

* * * * *